United States Patent [19]

Dzyck et al.

[11] 4,432,199

[45] Feb. 21, 1984

[54] MACHINE FOR SZ-TWISTING BY MEANS OF A TWISTING DISC AND A TUBULAR ACCUMULATOR

[75] Inventors: Wolfgang Dzyck, Neustadt; Bernd Hoppe, Berlin; Martin Loczenski, Neustadt; Dieter Vogelsberg, Coburg; Fred Wolf, Rödental, all of Fed. Rep. of Germany

[73] Assignee: Siemens Aktiengesellschaft, Munich, Fed. Rep. of Germany

[21] Appl. No.: 383,121

[22] Filed: May 28, 1982

[30] Foreign Application Priority Data

Jun. 5, 1981 [DE] Fed. Rep. of Germany ..... 3123171

[51] Int. Cl.[3] ..... D07B 3/00; D07B 7/00

[52] U.S. Cl. ..... 57/294

[58] Field of Search ..... 57/6, 293, 294, 138

[56] References Cited

U.S. PATENT DOCUMENTS

| | | | |
|---|---|---|---|
| 3,460,334 | 8/1969 | Lawrenson et al. | 57/293 X |
| 4,056,925 | 11/1977 | Vogelsberg | 57/293 |
| 4,214,430 | 7/1980 | Vogelsberg et al. | 57/294 X |
| 4,359,857 | 11/1982 | Oestereich | 57/294 X |

FOREIGN PATENT DOCUMENTS

| | | |
|---|---|---|
| 682267 | 10/1939 | Fed. Rep. of Germany . |
| 2411151 | 9/1975 | Fed. Rep. of Germany . |

*Primary Examiner*—Donald Watkins

*Attorney, Agent, or Firm*—Kenyon & Kenyon

[57] ABSTRACT

An S-Z twisting machine including a twisting disc operated reversibly at the speed $n_1$ and a tubular accumulator driven with the lower speed $n_2$. The elements to be twisted which are applied to the tubular accumulator via an aperture guide disc, are preferably conducted through a further aperture guide disc which is rigidly connected to the tubular accumulator near its center to insure that the loops before and behind the further guide disc are equal per unit length of the tubular accumulator.

9 Claims, 5 Drawing Figures

MACHINE FOR SZ-TWISTING BY MEANS OF A TWISTING DISC AND A TUBULAR ACCUMULATOR

BACKGROUND OF THE INVENTION

This invention relates to a machine for SZ-twisting by means of a stationary aperture guide disc and a reversingly driven twisting disc, where the elements to be twisted are fed to the twisting disc (or closer) along a tubular guide and accumulator structure (tubular accumulator) which is arranged concentrically to the twisting axis and extends from the aperture guide disc to the twisting disc.

SZ twisting apparatus, in which the unwinding and pull-off operations are fixed in space, is becoming more and more important in cable manufacturing for a number of reasons. In some cases, a machine for SZ-twisting which is called a tubular accumulator twisting machine and works with a reversibly driven twisting disc, to which the elements to be twisted are fed via a tubular accumulator, has found acceptance.

In twisting with such a tubular accumulator machine, the individual elements are applied in part helically to the outer surface of the tubular accumulator and subsequently pulled off from this surface by means of a pull-off device.

Because the elements in this operation are pulled over the tubular accumulator, a friction coefficient as small as possible is desired therefor in order to keep the tension on the twisting elements low.

In the known tubular accumulator S-Z methods, it is customary to make the tubular accumulator ahead of the alternatingly rotating twisting disc either non-rotatable or freely rotatable, or to rotate it about the longitudinal axis at the speed of the twisting disc. In general, the tubular accumulator is made stationary or it is driven at the speed of the twisting disc, so that no uncontrolled motions of the elements to be twisted relative to the tubular accumulator result under the influence of inertial and friction forces.

In tubular accumulators which are arranged fixed or rotate together with the twisting disc at the same speed of rotation, the problem of the loops of the elements to be twisted on the tubular accumulator backing up either at the beginning or at the end of the tube, i.e., becoming particularly close, arises.

According to experience, the tensile forces to be supplied in passing through the S-Z twisting machine increase more than proportionally with the angle at which the elements to be twisted are looped around the tube. If the distribution of the loops in the longitudinal direction is uneven, particularly large forces must therefore be overcome which can lead to tear-off. It is therefore of interest to distribute the loops uniformly over the tubular accumulator.

The tubular accumulator usually has considerable mass which, if it is rigidly coupled to the twisting disc, makes changing directions more difficult. This change in direction, however, must be executed quickly in order to make the twist changing sections as short as possible.

SUMMARY OF THE INVENTION

It is an object of the present invention to reduce the above-mentioned difficulties. To solve this problem, according to the present invention, the drives for the twisting disc and the tubular accumulator are such that the tubular accumulator can be driven at a speed of rotation which is different from the speed of the twisting disc.

In this manner, it is possible to better match the speed of rotation to the requirements of the individual case. For instance, the friction forces which occur between the tubular accumulator and the elements to be twisted can be better controlled by reducing the speed of the tubular accumulator relative to the speed of the twisting disc. This is the case particularly if many elements to be twisted are conducted on the tubular accumulator in parallel and the looping period must be chosen large because the elements to be twisted permit only large radii of curvature. This, however, also means long friction distances which must be overcome by the elements to be twisted.

To this must be added the fact that the elements to be twisted, when they have placed themselves around the tubular accumulator, exert a "choke effect" on this body and thereby increase the friction still further.

The deviation of the speed of the tubular accumulator from the rotary speed of the twisting disc can be brought about in various ways. A transmission can be arranged between the drive for the twisting disc and the tubular accumulator, and this transmission can optionally be designed as a multi-step transmission or as an adjustable transmission. However, a separate drive may also be assigned to the tubular accumulator.

Generally, one attempts to obtain the largest possible number of twisting lays in the finished strand assembly. This leads to the desire to accommodate the largest possible number of loops in a tubular accumulator without trouble. As tests have shown, the number of possible loops is largest if they are distributed uniformly.

In one embodiment of the present invention, the drive of the tubular accumulator is designed in such a manner that the tubular body rotates approximately at half the speed of the twisting disc. As used herein "approximately" encompasses deviations on the order of about ±20% from the exact value.

If it assumed that the speed of rotation from the entry of a twisting element onto the tubular body to the twisting disc increases from zero to n, n being the speed of rotation of the twisting disc, then a tubular accumulator driven with approximately half the speed has the advantage that the material to be twisted has, at both ends of the tubular accumulator, only half the speed difference relative to the tubular accumulator, and the speed of the material to be twisted and that of the tubular accumulator even agree in the middle of the tubular accumulator.

Because of the last-mentioned situation, it is advantageous to arrange, on a tubular accumulator which is driven with approximately half the speed of the twisting disc, approximately at its middle, a rigid guide hole disc for the elements to be twisted which insures that the loops provided in front and in back of this supplemental hole disc are equal per unit length of the tubular accumulator.

In this case the arrangement of the guide hole disc rigidly connected to the tubular accumulator only needs to be arranged approximately at its center and may also deviate from this central position by about ±20% according to the magnitude of the speed of the tubular accumulator.

The tubular accumulator which is provided with a guide hole disc firmly connected to it at its center will preferably be supported in a stationary stand, e.g., with a pillow block in the vicinity of this guide hole disc. Also, the drive for the tubular accumulator can advantageously be arranged in the vicinity of the pillow block.

DETAILED DESCRIPTION

To simplify the presentation, only one element to be twisted, brought along the outer surface of the tubular accumulator, is drawn in most of the figures. Like parts are provided with the same reference symbols in all figures.

Figure 1:
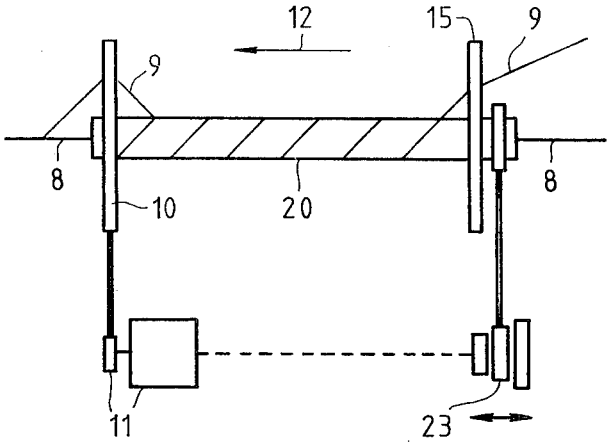
FIG. 1 is a schematic diagram of a tubular accumulator twisting machine in which the tubular accumulator is driven by the drive of the twisting disc with the interposition of a transmission.

The apparatus for SZ twisting according to FIG. 1 includes a twisting disc 10 reversibly driven by the drive 11, and a tubular accumulator 20 which extends approximately between the twisting disc 10 and a guide hole disc 15. The tubular accumulator is driven by the drive 11 of the twisting disc with the interposition of a transmission 23 which may be realized as a multi-step or variably adjustable transmission. The elements to be twisted 8 which belong to the core layer, are conducted through the tubular accumulator, while the elements to be twisted 9, which are to be newly put down, are fed by the guide hole disc 15 along the outer surface of the tubular accumulator 20 to the twisting disc 10. The direction of fabrication is indicated by the arrow 12.

Figure 2:
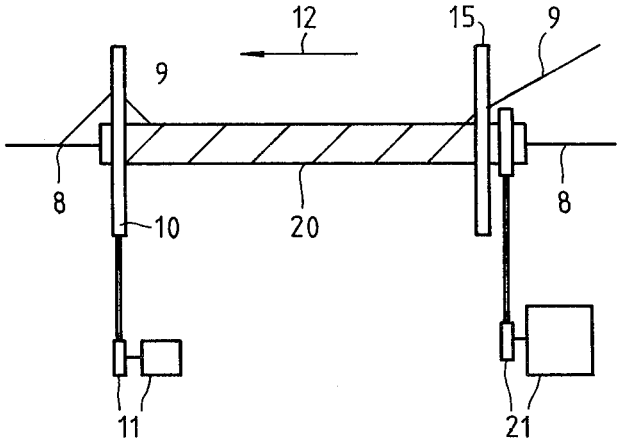
FIG. 2 is a schematic diagram of a tubular accumulator twisting machine in which the tubular accumulator is equipped with a drive of its own.

The apparatus for SZ twisting according to FIG. 2 includes a twisting disc 10 reversibly driven by the drive 11, and of a tubular accumulator 20 which extends from the twisting disc 10 to a stationary guide hole disc 15. A separate drive 21 is assigned to the tubular accumulator. The twisting disc 10, which has little mass, can be reversed very quickly by its own drive, while the tubular accumulator which has a large mass, has a substantially more rugged drive which need not be reversed with the same speed. The elements to be twisted which belong to the core layer are conducted through the tubular accumulator, while the elements to be twisted 9 which belong to the layer to be newly deposited (only one element is shown) are fed along the outside surface to the tubular accumulator 20 of the twisting disc 10 through the guide hole disc 15.

Figure 3:
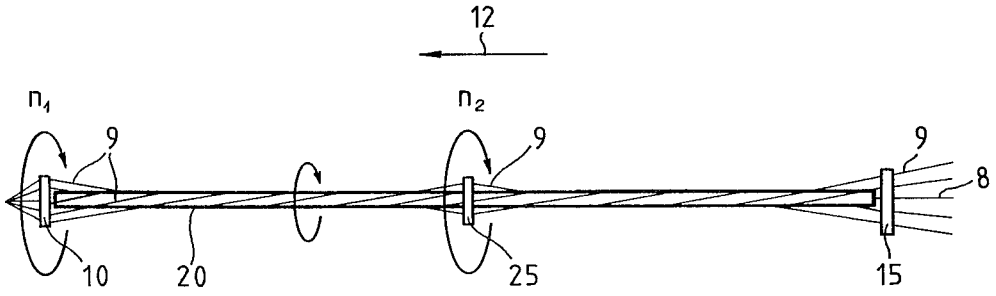
FIG. 3 is a schematic drawing of a tubular accumulator twisting machine in which the tubular accumulator carries a rigid guide hole disc.

FIG. 3 shows a tubular accumulator S-Z twisting machine with the setup corresponding to FIGS. 1 and 2 including twisting disc 10, tubular accumulator 20 and guide hole disc 15. The drives are not shown. It is assumed that twisting disc 10 is operated at a speed $n_1$, while the tubular accumulator is operated at a different speed $n_2$, which is approximately equal to $n_1/2$. These speed relationships result in a particularly uniform distribution of the loops of the elements to be twisted 9 over the entire length of the tubular accumulator.

Approximately in the middle of the tubular accumulator 20, a guide hole disc 25 is arranged rigidly connected thereto. This guide hole disc insures that the number of loops of the elements to be twisted 9 present before and behind the hole disc, per unit length of the tubular accumulator, is the same.

Figure 4:
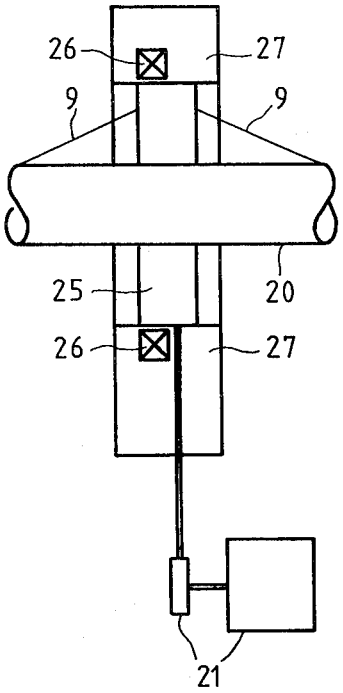
FIG. 4 is a detail of FIG. 3, illustrating the support of the tubular accumulator in the vicinity of the guide hole disc firmly connected thereto.

In FIG. 4, the region of the tubular accumulator 20 with the guide hole disc 25 is shown enlarged as a detail of FIG. 3. The tubular accumulator 20 is supported through the guide hole disc 25 by means of the bearings 26 and the pillow block 27. In this area, the separate drive 21 for the tubular accumulator 20 is also provided.

Figure 5:
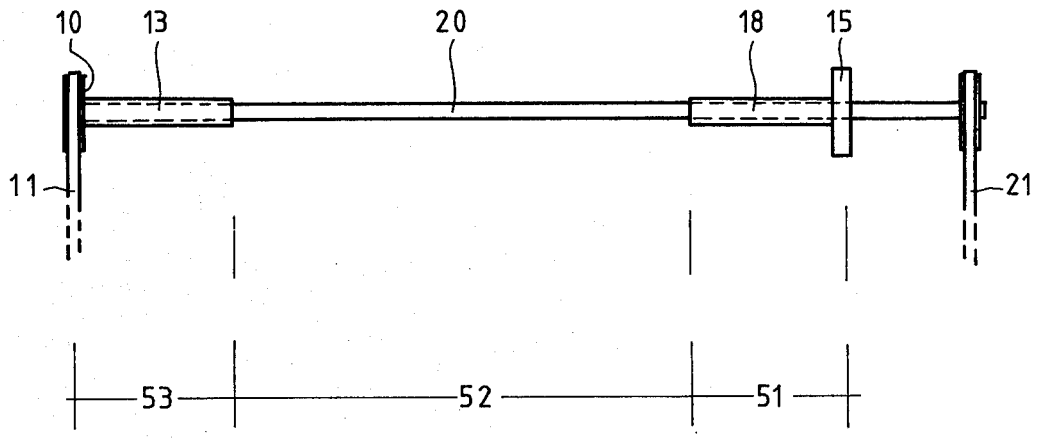
FIG. 5 is a schematic drawing of the tubular accumulator twisting machine with a tubular accumulator having different speed of rotation steps.

The tubular accumulator SZ twisting machine shown in FIG. 5 (elements to be twisted not shown for reasons of clarity) in the usual manner includes a twisting disc 10 which is operated reversibly by a drive 11, a tubular accumulator 20 provided with a separate drive 21 and a guide hole disc 15. Sleeves 18 and 13, which extend beyond the tubular accumulator over part of its length and thus form different speed ranges of the tubular accumulator, are firmly connected to the stationary guide hole disc 15 and to the twisting disc 10 which rotates with a speed different from the speed of the tubular accumulator.

If, for instance, the speed of rotation of the twisting disc is 100% and that of the tubular accumulator is about 30 to 70%, then the sleeve connected to the guide hole disc 15 forms a tubular accumulator section 51 with the speed zero, which is followed by a section 52 with the speed of rotation of the tubular accumulator 20. This is followed by a further section 53 which has the speed of rotation of the twisting disc.

The situation can easily be changed, as a glance at FIG. 5 shows; for instance, the sleeve 18 can be made long enough that it covers almost one-half of the tubular accumulator 20, so that therefore the speed zero is assigned to one-half the length of the tubular accumulator. In this case, the adjacent region of the tubular accumulator will be operated with perhaps 75% of the speed of the twisting disc 10. In any event, with such devices, particularly uniform loops of the elements to be twisted are obtained along the entire tubular accumulator.

What is claimed is:

1. In a machine for SZ-twisting by means of a stationary aperture guide disc and a reversibly driven twisting disc, where the elements to be twisted are fed to the twisting disc along a tubular guide and tubular accumulator arranged concentrically to the twisting axis and extending from the aperture guide disc to the twisting disc, the improvement comprising drives for the twisting disc and the tubular accumulator designed so that the tubular accumulator can be driven at a speed of rotation which differs from the speed of the twisting disc.

2. The improvement according to claim 1 wherein a common drive is provided for the twisting disc and the tubular accumulator, and where a transmission is arranged between the drive for the twisting disc and the tubular accumulator.

3. The improvement according to claim 2, wherein said the transmission is a multi-stage transmission.

4. The improvement according to claim 2, wherein said transmission is a variable transmission.

5. The improvement according to claim 1, wherein a separate drive is provided for the tubular accumulator.

6. The improvement according to claim 1 or 5, wherein said drives are adapted to drive the tubular accumulator so that it rotates with approximately one-half the speed of the twisting disc.

7. The improvement according to claim 6, and further including a rigid aperture guide disc for the elements to be twisted approximately in the middle of said tubular accumulator.

8. The improvement according to claim 7, wherein the tubular accumulator and the aperture guide disc rigidly connected thereto are rotatably supported in a stationary pillow block in the vicinity of said aperture guide disc.

9. The improvement according to claim 8, wherein the drive for the tubular accumulator and the aperture guide disc rigidly connected thereto is arranged in the vicinity of said pillow block.

* * * * *